US005602928A

United States Patent [19]

Eriksson et al.

[11] Patent Number: 5,602,928

[45] Date of Patent: Feb. 11, 1997

[54] MULTI-CHANNEL COMMUNICATION SYSTEM

[75] Inventors: Larry J. Eriksson; Cary D. Bremigan, both of Madison, Wis.

[73] Assignee: Digisonix, Inc., Middleton, Wis.

[21] Appl. No.: 368,920

[22] Filed: Jan. 5, 1995

[51] Int. Cl.[6] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 4,677,676 | 6/1987 | Eriksson . | |
| 5,033,082 | 7/1991 | Eriksson et al. . | |
| 5,216,721 | 6/1993 | Melton . | |
| 5,216,722 | 6/1993 | Popovich . | |
| 5,245,664 | 9/1993 | Kinoshite et al. | 381/71 |
| 5,325,437 | 6/1994 | Doi et al. | 381/71 |
| 5,327,496 | 7/1994 | Russell et al. | 381/71 |
| 5,513,265 | 4/1996 | Hirano | 381/94 |

OTHER PUBLICATIONS

"Improved Hands–Free Microphone for Automotive Communications", C. Roger Anderson, Audio Engineering Society, Oct. 1983.

"Active Adaptive Sound Control in a Duct: A Computer Simulation", J. C. Burgess, Journal of Acoustic Society of America, 70(3), Sep. 1981, pp. 715–726.

*Primary Examiner*—Forester W. Isen

*Attorney, Agent, or Firm*—Andrus, Sceales, Starke & Sawall

[57] ABSTRACT

A multi-channel communication system is provided. In an active acoustic attenuation implementation, noise, including cross-coupled noise between channels and locations, designated audio signals, and echoes, are canceled, but not speech from another location. A particularly desirable vehicle application is provided.

24 Claims, 4 Drawing Sheets

MULTI-CHANNEL COMMUNICATION SYSTEM

BACKGROUND AND SUMMARY

The invention relates to multi-channel communication systems, including active acoustic attenuation systems, and vehicle applications.

The invention arose during continuing development efforts relating to the subject matter of U.S. Pat. Nos. 4,677,676, 5,033,082, 5,216,721 and 5,216,722, all incorporated herein by reference. The invention involves an intercom communication system in a multi-channel application having one or more zones subject to noise from one or more noise sources, and one or more speaking locations in each zone.

One exemplary application of the invention is in an automobile where the front seat is a first zone and the rear seat is a second zone, and the left front passenger is in a first speaking location, the right front passenger is in a second speaking location, the left rear passenger is in a third speaking location, and the right rear passenger is in a fourth speaking location. Engine noise, road noise, etc. is canceled at each location, including cross-coupled noise between channels, but not speech from another location.

The invention has numerous other applications where communication is desired in multi-channel noisy environments.

DETAILED DESCRIPTION

Figure 1:
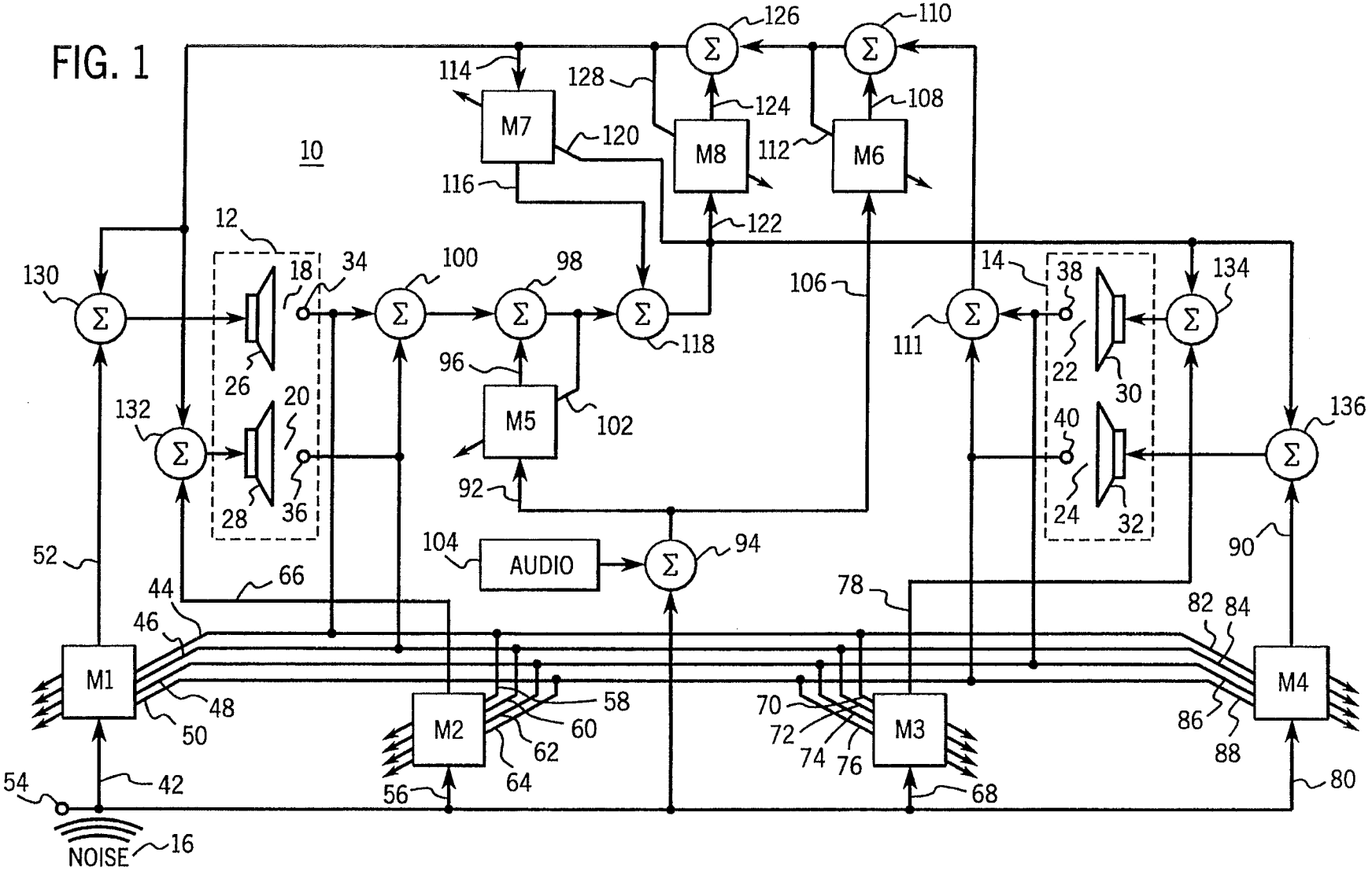
FIG. 1 shows an active acoustic attenuation system in accordance with the invention.

FIG. 1 shows an active acoustic attenuation system 10 including plural zones such as 12 and 14 subject to noise from one or more noise sources. There may be a single noise source such as shown at 16, or multiple noise sources for example as shown in incorporated U.S. Pat. No. 5,033,082 at 14 and 18. Each zone includes one or more speaking locations, for example 18 and 20 in zone 12, and 22 and 24 in zone 14, such that a person at a speaking location is subject to noise from one or more noise sources. Speakers 26 and 28 introduce sound into zone 12 at respective speaking locations 18 and 20. Speakers 30 and 32 introduce sound into zone 14 at respective speaking locations 22 and 24. Error microphones 34 and 36 sense noise and speech at respective speaking locations 18 and 20. Error microphones 38 and 40 sense noise and speech at respective speaking locations 22 and 24.

A plurality of adaptive filter models M1, M2, M3, M4 each cancel noise from a respective noise source at a respective speaking location as sensed by a respective error microphone. Model M1 has a model input 42 from a reference signal correlated to the noise from the respective noise source. Model M1 has a plurality of error inputs 44, 46, 48, 50 from respective error microphones 34, 36, 38, 40.

Model M1 has an output 52 outputting a correction signal to introduce canceling sound at respective speaking location 18 to cancel noise from respective noise source 16, such that the output of error microphone 34 carries a speech signal from a person at speaking location 18 but not a noise signal from noise source 16. Noise from source 16 is sensed at input transducer 54 provided by an input microphone which outputs a noise signal correlated to the noise. In the case of a periodic noise source, the input transducer may be provided by a tachometer or the like, or may be eliminated for example as in incorporated U.S. Pat. No. 5,216,722. In the embodiment shown, an input microphone is preferred for transducer 54 to sense engine noise, which is periodic but which period may change at changing engine speeds, and also to sense random noise such as road noise etc. Model M2 has a model input 56, error inputs 58, 60, 62, 64, and a model output 66. Model M3 has a model input 68, error inputs 70, 72, 74, 76, and a model output 78. Model M4 has a model input 80, error inputs 82, 84, 86, 88, and a model output 90. Models M2, M3 and M4 may receive their model input signals from the same transducer 54 as model M1 or from other transducers or may sense noise from other noise sources, for example as in incorporated U.S. Pat. No. 5,033,082. In the disclosed embodiment, each of the models receives its model input signal from the same reference signal correlated to engine and road noise, and have model output signals 52, 66, 78, 90, respectively to right front speaker 26, left front speaker 28, right rear speaker 30, left rear speaker 32 of an automobile.

The output of error microphone 34 carrying the speech of a person at speaking location 18 is supplied to speakers 30 and 32 at speaking locations 22 and 24, such that a person at location 22 can hear the speech of the person at location 18, and a person at location 24 can hear the speech of the person at location 18. The output of error microphone 36 carrying the speech of a person at location 20 is supplied to speakers 30 and 32 at locations 22 and 24, such that a person at location 22 can hear the speech of a person at location 20, and a person at location 24 can hear the speech of a person at location 20. The output of error microphone 38 carrying the speech of a person at location 22 is supplied to speaker 26 at location 18 and to speaker 28 at location 20, such that a person at location 18 can hear the speech of a person at location 22, and a person at location 20 can hear the speech of a person at location 22. The output of error microphone 40 carrying the speech of a person at location 24 is supplied to speaker 26 at location 18 and to speaker 28 at location 20, such that a person at location 18 can hear the speech of a person at location 24, and a person at location 20 can hear the speech of a person at location 24.

Each of models M1, M2, M3, M4 has an error input from each of the error microphones 34, 36, 38, 40. Model M1 has error inputs 44, 46, 48, 50 from error microphones 34, 36, 38, 40, respectively. Model M1 has a model output 52 supplied to speaker 26. Model M2 has error inputs 58, 60, 62, 64 from error microphones 34, 36, 38, 40, respectively. Model M2 has a model output 66 supplied to speaker 28. Model M3 has error inputs 70, 72, 74, 76 from error microphones 34, 36, 38, 40, respectively. Model M3 has a model output 78 supplied to speaker 30. Model M4 has error inputs 82, 84, 86, 88 from error microphones 34, 36, 38, 40, respectively. Model M4 has a model output 90 supplied to speaker 32. In the embodiment shown, zones 12 and 14 are subject to noise from a common noise source 16, and models M1, M2, M3, M4 have model inputs 42, 56, 68, 80, respectively, receiving a common reference signal from input microphone 54 correlated to noise from common noise source 16. Each of models M1, M2, M3, M4 is preferably an IIR (infinite impulse response) filter for example as disclosed in incorporated U.S. Pat. No. 4,677,676, or alternatively an FIR (finite impulse response) filter, though other types of adaptive filter models may be used.

Adaptive filter model M5 has a model input 92 receiving through summer 94 a noise signal from input microphone 54 correlated with noise from noise source 16. Model M5 has a model output 96 summed at summer 98 with the output of summer 100 which sums the outputs of error microphones 34 and 36. Model M5 has an error input 102 from the output of summer 98. Models M1 and M2 acoustically cancel noise in the respective outputs of error microphones 34 and 36, and model M5 electrically cancels noise in the outputs of error microphones 34 and 36. Summer 94 also has an input from audio source 104, which may for example be the audio system or the like of the automobile, to thus cancel such audio signal component in the signal supplied from summer 98 to speakers 30 and 32, such that a person at such locations hears only speech from locations 18 and 20 and not road noise nor noise from the automobile radio or audio system. Model M6 has a model input 106 from summer 94. Model M6 has a model output 108 summed at summer 110 with the output of summer 111 which sums the outputs of error microphones 38 and 40. Model M6 has an error input 112 from the output of summer 110. Model M6 electrically cancels noise from noise source 16 and audio noise or sound from source 104 in the signal transmitted to speakers 26 and 28.

Model M7 has a model input 114 from the signal from error microphones 38 and 40, a model output 116 summed at summer 118 with the output of summer 98, and an error input 120 from the output of summer 118. Model M7 cancels the speech of a person at locations 22 or 24 in the signal sent to speakers 30 and 32 at such locations 22 and 24, to thus eliminate echo. Model M8 has a model input 122 from the signal from error microphones 34 and 36, a model output 124 supplied to summer 126, and an error input 128 from the output of summer 126. Model M8 cancels the speech of persons at locations 18 and 20 from the signal sent to speakers 26 and 28 at such locations 18 and 20, to eliminate echo. Each of models M5, M6, M7, M8 is preferably an FIR filter, though other types of adaptive filters may be used.

Summer 130 has an input from model M1 and an input from summer 126, and has an output supplied to speaker 26. Summer 132 has an input from model M2 and an input from summer 126, and has an output supplied to speaker 28. Summer 134 has an input from model M3 and an input from summer 118, and has an output supplied to speaker 30. Summer 136 has an input from model M4 and an input from summer 118, and has an output supplied to speaker 32.

Figure 2:
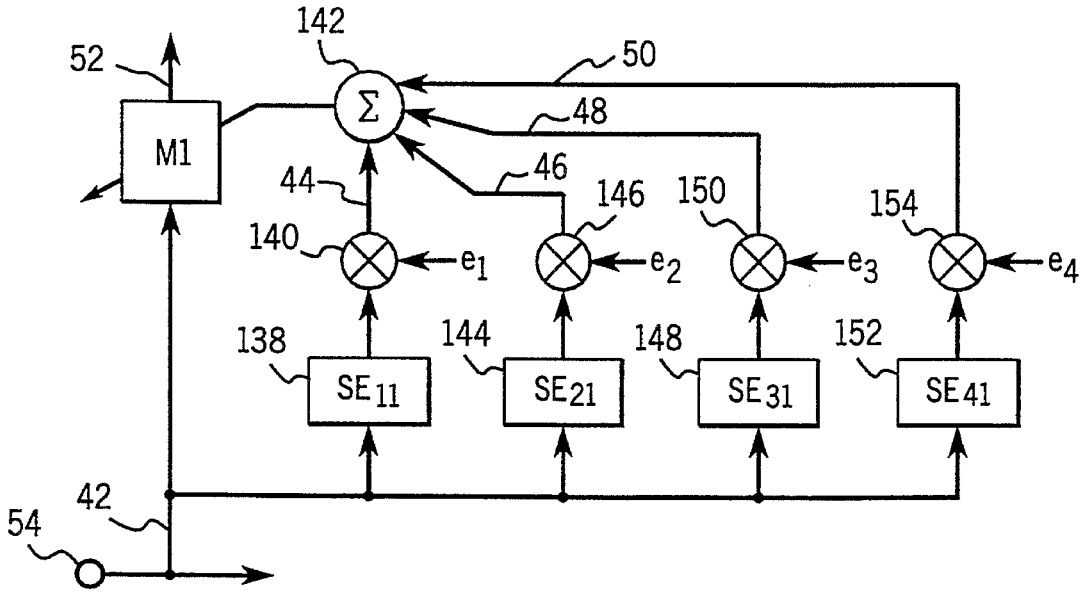
FIG. 2 further illustrates a portion of the system of FIG. 1.

As noted above, each channel model M1, M2, M3, M4 has an error input from each of the error microphones 34, 36, 38, 40. The system includes a plurality of error paths, including a first set of error paths including an error path $SE_{11}$ to the first error microphone 34 from the first speaker 26, an error path $SE_{21}$ to the second error microphone 36 from the first speaker 26, an error path $SE_{31}$ to the third error microphone 38 from the first speaker 26, and an error path $SE_{41}$ to the fourth error microphone 40 from the first speaker 26, i.e. between speaker 26 and each of error microphones 34, 36, 38, 40. Likewise, there are error paths from speaker 28 to each of error microphones 34, 36, 38, 40, and from speaker 30 to each of error microphones 34, 36, 38, 40, and from speaker 32 to each of error microphones 34, 36, 38, 40. As in incorporated U.S. Pat. No. 5,216,721, these error paths are modeled, and the transfer functions thereof are provided in the channel models. For example, M1 model input 42 is supplied through error path transfer function model $SE_{11}$ at 138, FIG. 2, and multiplied at multiplier 140 with the error signal $e_1$ from error microphone 34 to provide a weight update signal to summer 142. Model input 42 is supplied through the $SE_{21}$ error path transfer function model at 144 and multiplied at multiplier 146 with the error signal $e_2$ from error microphone 36 to provide a weight update signal to summer 142. Model input 42 is supplied through the error path $SE_{31}$ transfer function model at 148 and multiplied at multiplier 150 with error signal $e_3$ from error microphone 38 to provide a weight update signal to summer 142. Model input 42 is supplied through the error path $SE_{41}$ transfer function model at 152 and multiplied at multiplier 154 with error signal $e_4$ from error microphone 40 to provide a weight update signal to summer 142. The output of summer 142 provides the weight update signal for model M1. The multiple error signal processing for models M2, M3, M4 is comparable, and for which further reference may be had to incorporated U.S. Pat. Nos. 5,216,721 and 5,216,722.

As above noted, models M1, M2, M3, M4 acoustically cancel or control noise, and models M5, M6, M7, M8 electrically cancel or control noise. Models M1, M2, M3, M4 preferably include SE modeling, as noted above, and as in incorporated U.S. Pat. Nos. 5,216,721 and 5,216,722. Models M5, M6, M7, M8 do not include SE modeling. In one particularly efficient embodiment, models M1, M2, M3, M4 are performed by a first processor operating at a low sampling rate, e.g. one or two kHz, and models M5, M6, M7, M8 are performed by a second processor operating at a substantially higher sampling rate, e.g. seven to ten kHz, over a broad frequency band because of the electrical cancellation.

Figure 3:
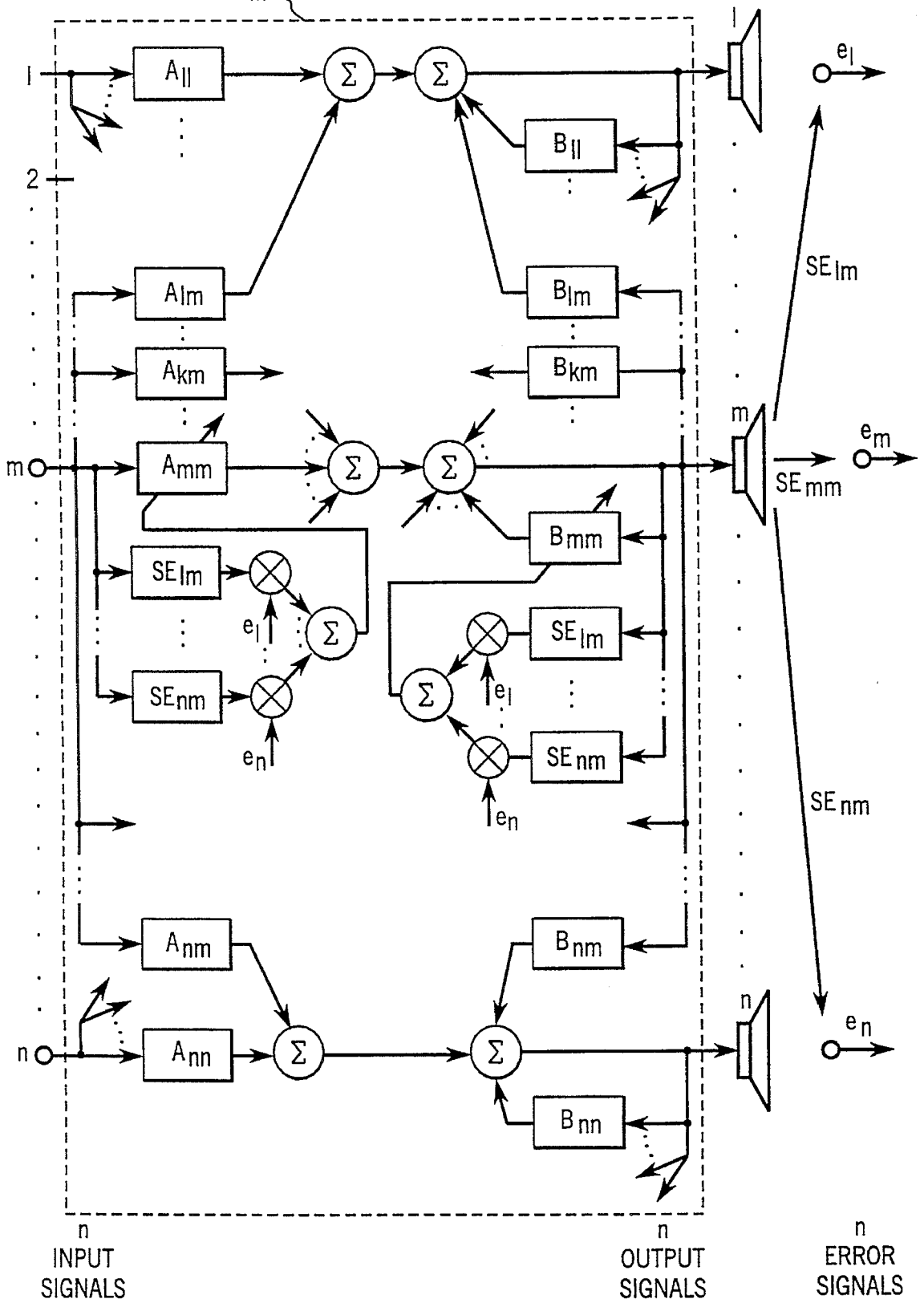
FIG. 3 shows a further active acoustic attenuation system.

The invention can be expanded to any number of channels and can be implemented by the model shown in incorporated U.S. Pat. No. 5,216,721. FIG. 3 herein is like FIG. 9 of incorporated U.S. Pat. No. 5,216,721 and shows the generalized system for n input signals from n input transducers, n output signals to n output transducers, and n error signals from n error transducers, extrapolating the above system. FIG. 3 shows the $m^{th}$ input signal from the $m^{th}$ input transducer providing an input to algorithm filter $A_{lm}$ through $A_{km}$ through $A_{mm}$ through $A_{nm}$. Algorithm filter $A_{mm}$ is updated by the weight update from the sum of the outputs of respective error path models $SE_{lm}$ through $SE_{nm}$ multiplied by respective error signals $e_l$ through $e_n$. Algorithm filter $A_{km}$ is updated by the weight update from the sum of the outputs of respective error path models $SE_{lk}$ through $SE_{nk}$ multiplied by respective error signals $e_l$ through $e_n$. The model output correction signal to the $m^{th}$ output transducer is applied to filter model $B_{lm}$, which is the recursive transfer function in the first channel model from the $m^{th}$ output transducer, and so on through $B_{km}$ through $B_{mm}$ through $B_{nm}$. Algorithm filter $B_{mm}$ is updated by the weight update from the sum of the outputs of respective SE error path models $SE_{lm}$ through $SE_{nm}$ multiplied by respective error signals $e_l$ through $e_n$. Algorithm filter $B_{km}$ is updated by the weight update from the sum of the outputs of respective error path models $SE_{lk}$ through $SE_{nk}$ multiplied by respective error signals $e_l$ through $e_n$. The system provides a multichannel generalized active acoustic attenuation system for complex sound fields. Each of the multiple channel models is intraconnected with all other channel models. The inputs and outputs of all channel models depend on the inputs and outputs of all other channel models. The total signal to the output transducers is used as an input to all other channel models. All error signals, e.g., $e_l \ldots e_n$, are used to update each channel.

It is preferred that each channel has its own input transducer, output transducer, and error transducer, though other combinations are possible. For example, a first channel may be the path from a first input transducer to a first output transducer, and a second channel may be the path from the first input transducer to a second output transducer. Each channel has a channel model, and each channel model is intraconnected with each of the remaining channel models, as above described. The system is applicable to one or more input transducers, one or more output transducers, and one or more error transducers, and at a minimum includes at least two input signals or at least two output transducers. One or more input signals representing the input acoustic wave providing the input noise are provided by respective input transducers, to the adaptive filter models. Only a single input signal need be provided, and the same such input signal may be input to each of the adaptive filter models. Such single input signal may be provided by a single input microphone, or alternatively the input signal may be provided by a transducer such as a tachometer which provides the frequency of a periodic input acoustic wave such as from an engine or the like. Further alternatively, the input signal may be provided by one or more error signals, as above noted, in the case of a periodic noise source, "Active Adaptive Sound Control In A Duct: A Computer Simulation", J. C. Burgess, Journal of Acoustic Society of America, 70(3), September 1981, pages 715–726. In the case of correlated input acoustic waves, the invention is further applicable as taught in incorporated U.S. Pat. No. 5,216,722.

Model inputs 42, 56, 68, 80 are provided from input microphone 54. In further embodiments, various combinations of input arrays can be used, including a summed array of inputs. The inputs can be provided from a variety of microphones, accelerometers, transformer sensors, duct sensors, optical sensors, and other types of transducers. The sensor or transducer outputs can be summed in a summed array or a weighted array with adaptive filtering to optimize the input signal. Likewise, the error signals can be a summed or weighted array. The error signals can be derived from error microphones mounted to occupant shoulder harnesses in a vehicle, to be described. The error sum could also be summed with ceiling microphones, headrest microphones, etc., or various combinations thereof. The canceling speakers can be the speakers of the vehicle audio system. The noted zones can be in vehicles such as cars, trucks, vans, buses, trains, ships, planes, etc. The zones can all be in the same vehicle, or one or more zones may be in a vehicle and other zones can be remote to the vehicle, including in other vehicles.

The invention provides a communication system including a plurality of zones subject to noise from one or more noise sources, the noise being acoustical and/or electrical, one or more speaking locations in each zone such that a person at a speaking location is subject to noise from a noise source, a plurality of speakers, each introducing sound into a respective zone at a respective speaking location, a plurality of microphones each sensing noise and speech at a respective speaking location, a plurality of adaptive filter models each canceling noise from a respective noise source, each model having a model input from a reference signal correlated to the noise from the respective noise source, each model having a plurality of error inputs, each model having an output outputting a correction signal to cancel noise from the respective noise source, such that the output of the microphone carries a speech signal from a person at the speaking location but not a noise signal from the noise source, the output of at least one microphone carrying the speech of a first person at one speaking location being supplied to at least one speaker at another speaking location, such that a second person at the other speaking location can hear the speech of the first person at the one speaking location.

Figure 4:
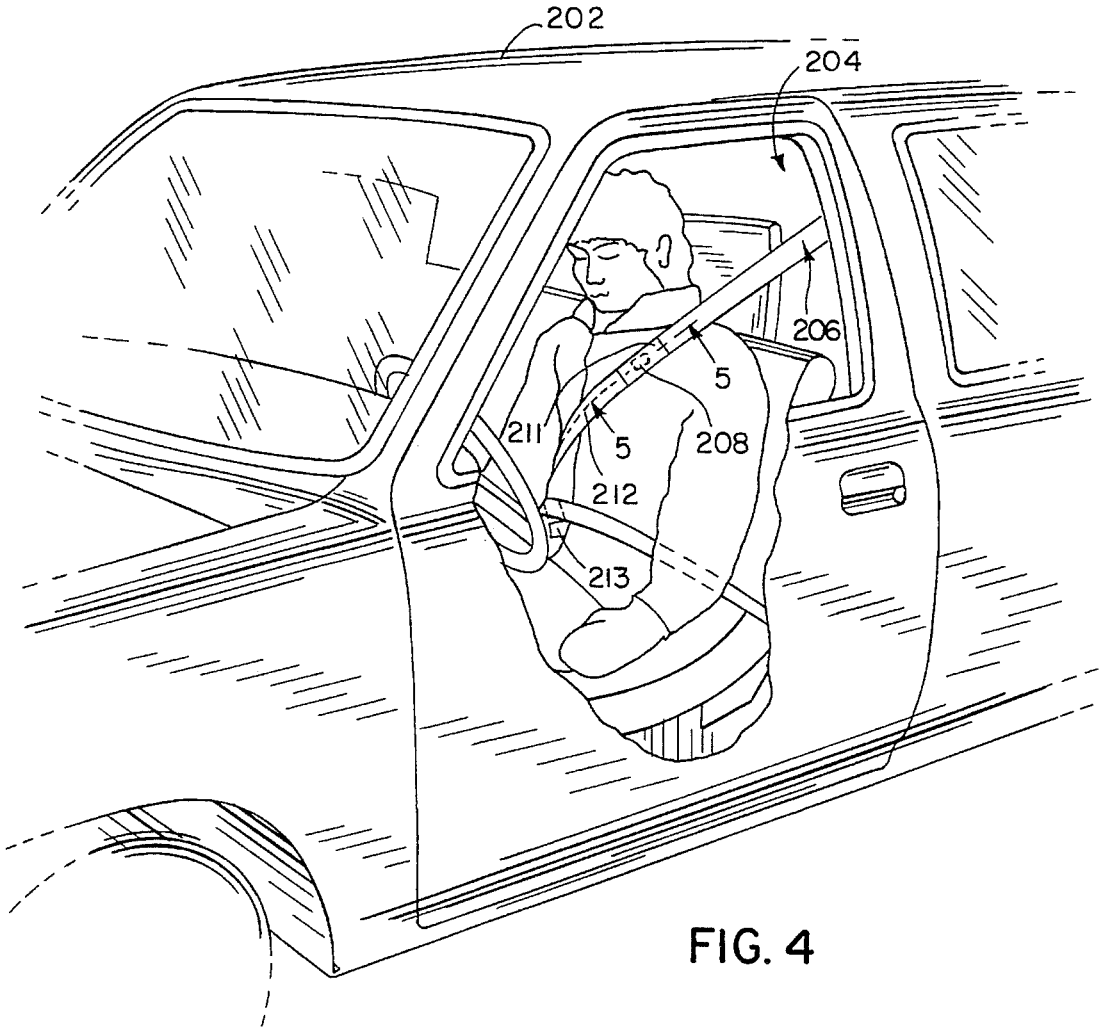
FIG. 4 is an isometric view, partially cut away, illustrating a further embodiment of the invention.
Figure 5:
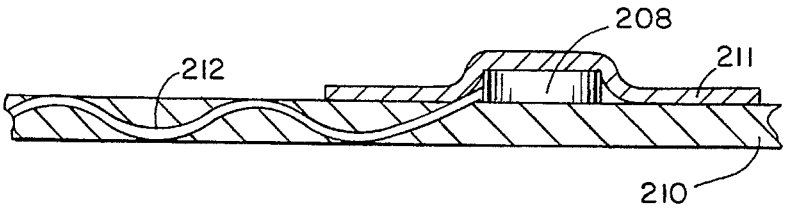
FIG. 5 is a sectional view taken along line 5—5 of FIG. 4.

FIGS. 4 and 5 show a particularly desirable embodiment for ease of use in a vehicle. At least one of the noted zones is in a vehicle 202 having an occupant restraint system 204 including a shoulder harness 206. At least one error microphone 208 is mounted to the shoulder harness. The shoulder harness includes a mesh belt 210. Error microphone 208 is embedded in the mesh belt or mounted thereto by a sound-transmissive layer or tape member 211 and has a connection wire 212 running along the belt and enmeshed therein, such that the error microphone and connection wire are part of the belt. The error microphone is automatically positioned in a proper location upon deployment of the belt. In a further embodiment, wire 212 is connected to a seatbelt interlock 213, such as the seatbelt anchor, to provide feedback information confirming deployment of the belt and the presence of an occupant at the respective location. In a further alternative embodiment, a wireless microphone 208 is used.

It is recognized that various equivalents, alternatives and modifications are possible within the scope of the appended claims.

We claim:

1. A communication system comprising:

a plurality of zones subject to noise from one or more noise sources;

one or more speaking locations in each zone such that a person at a speaking location is subject to noise from a noise source;

a plurality of speakers, each introducing sound into a respective zone at a respective speaking location;

a plurality of microphones each sensing noise and speech at a respective speaking location;

a plurality of adaptive filter models each canceling noise from a respective noise source, each model having a model input from a reference signal correlated to said noise from said respective noise source, each model having a plurality of error inputs, each model having an output outputting a correction signal to cancel noise from the respective noise source, such that the output of the microphone carries a speech signal from a person at the speaking location but not a noise signal from the noise source;

the output of at least one microphone carrying the speech of a first person at one speaking location being supplied to at least one speaker at another speaking location, such that a second person at said other speaking location can hear the speech of said first person at said one speaking location.

2. The invention according to claim 1 comprising a first set of a plurality of adaptive filter models each acoustically canceling noise, and a second set of a plurality of adaptive filter models each electrically canceling noise.

3. The invention according to claim 2 wherein said first set of models includes modeling of at least one of a respective said speaker and the respective path between the speaker and a respective microphone, and wherein said second set of models are operated at a substantially higher sampling rate than said first set of models.

4. The invention according to claim 1 wherein at least one of said models has a model input from a summer summing said noise with a designated audio signal.

5. The invention according to claim 1 wherein at least one of said zones is in a vehicle having an occupant restraint system including a shoulder harness, and wherein at least one of said microphones is mounted to said shoulder harness.

6. The invention according to claim 1 wherein each of said zones is in a vehicle.

7. The invention according to claim 6 wherein all of said zones are in the same vehicle.

8. The invention according to claim 1 wherein at least one of said zones is in a vehicle, and at least another of said zones is external to said vehicle.

9. An active acoustic attenuation system comprising:

a plurality of zones subject to noise from one or more noise sources;

one or more speaking locations in each zone such that a person at a speaking location is subject to noise from a noise source;

a plurality of speakers, each introducing sound into a respective zone at a respective speaking location;

a plurality of error microphones each sensing noise and speech at a respective speaking location;

a plurality of adaptive filter models each canceling noise from a respective noise source at a respective speaking location as sensed by a respective error microphone, each model having a model input from a reference signal correlated to said noise from said respective noise source, each model having a plurality of error inputs from respective error microphones, each model having an output outputting a correction signal to introduce canceling sound at the respective speaking location to cancel noise from the respective noise source, such that the output of the error microphone carries a speech signal from a person at the speaking location but not a noise signal from the noise source;

the output of at least one error microphone carrying the speech of a first person at one speaking location being supplied to at least one speaker at another speaking location, such that a second person at said other speaking location can hear the speech of said first person at said one speaking location.

10. The invention according to claim 9 wherein each said model has an error input from each of said error microphones.

11. The invention according to claim 9 comprising:

a first said zone comprising first and second speaking locations;

a second said zone comprising third and fourth speaking locations;

a first said speaker at said first speaking location;

a second said speaker at said second speaking location;

a third said speaker at said third speaking location;

a fourth said speaker at said fourth speaking location;

a first said error microphone at said first speaking location;

a second said error microphone at said second speaking location;

a third said error microphone at said third speaking location;

a fourth said error microphone at said fourth speaking location;

a first said model having a model output to said first speaker, and first, second, third and fourth error inputs from said first, second, third and fourth error microphones, respective;

a second said model having a model output to said second speaker, and first, second, third and fourth error inputs from said first, second, third and fourth error microphones, respective;

a third said model having a model output to said third speaker, and first, second, third and fourth error inputs from said first, second, third and fourth error microphones, respective;

a fourth said model having a model output to said fourth speaker, and first, second, third and fourth error inputs from said first, second, third and fourth error microphones, respective.

12. The invention according to claim 11 wherein said first and second zones are subject to noise from a common noise source, and each of said first, second, third and fourth models has a model input receiving a common reference signal correlated to noise from said common noise source.

13. The invention according to claim 11 comprising:

a fifth adaptive filter model;

a sixth adaptive filter model;

a seventh adaptive filter model;

an eighth adaptive filter model;

a first summer having an input from said first model, and an output supplied to said first speaker;

a second summer having an input from said second model, and an output supplied to said second speaker;

a third summer having an input from said third model, and an output supplied to said third speaker;

a fourth summer having an input from said fourth model, and an output supplied to said fourth speaker;

a fifth summer having an input from said fifth model;

a sixth summer having an input from said sixth model;

a seventh summer having an input from said seventh model;

an eighth summer having an input from said eighth model;

a ninth summer having an input from said first error microphone and another input from said second microphone, and having an output supplied to said fifth summer;

a tenth summer having an input from said third error microphone and another input from said fourth error microphone, and having an output supplied to said sixth summer;

said fifth summer having an output supplied to said seventh summer and to an error input of said fifth model;

said sixth summer having an output supplied to said eighth summer and to an error input of said sixth model;

said seventh summer having an output supplied to said third and fourth summers and to a model input of said eighth model and to an error input of said seventh model;

said eighth summer having an output supplied to said first and second summers and to a model input of said seventh model and to an error input of said eighth model.

14. The invention according to claim 13 wherein each said first and second zones are subject to noise from a common noise source, and each of said first, second, third, fourth, fifth and sixth models has a model input receiving a common reference signal correlated to noise from said common noise source.

15. The invention according to claim 14 comprising an eleventh summer having an input from said common reference signal and another input from a designated audio signal, and having an output supplied to said model inputs of said fifth and sixth models.

16. The invention according to claim 9 comprising a first set of a plurality of adaptive filter models each acoustically canceling noise, and a second set of a plurality of adaptive filter models each electrically canceling noise.

17. The invention according to claim 16 wherein at least one model of said second set has a model input from a summer summing said noise with a designated audio signal to cancel said designated audio signal at the respective speaking location.

18. The invention according to claim 16 wherein said first set of models includes modeling of at least one of a respective said speaker and the respective error path between the speaker and a respective said error microphone, and wherein said second set of models are operated at a substantially higher sampling rate than said first set of models.

19. The invention according to claim 9 wherein at least one of said zones is in a vehicle having an occupant restraint system including a shoulder harness, and wherein at least one of said error microphones is mounted to said shoulder harness.

20. The invention according to claim 9 comprising a further plurality of adaptive filter models each canceling speech of a person in one zone from the signal sent to a speaker in said one zone from an error microphone in another zone.

21. The invention according to claim 9 wherein each of said zones is in a vehicle.

22. The invention according to claim 21 wherein all of said zones are in the same vehicle.

23. The invention according to claim 9 wherein at least one of said zones is in a vehicle, and at least another of said zones is external to said vehicle.

24. An occupant restraint system for a vehicle, comprising a shoulder harness including a belt, and a communication system microphone mounted to said belt such that said microphone is automatically positioned in proper location upon deployment of said belt, and a wire running from said microphone and connected to a seat belt interlock to provide feedback information confirming deployment of said belt and presence of an occupant in the respective location.

* * * * *